United States Patent [19]

Haentjens

[11] Patent Number: 4,655,684

[45] Date of Patent: Apr. 7, 1987

[54] CENTRIFUGAL PUMP FOR WIDE RANGE OF OPERATING CONDITIONS

[76] Inventor: Walter D. Haentjens, R.D. No. 1, Box 121, Sugarloaf, Pa. 18249

[21] Appl. No.: 637,158

[22] Filed: Aug. 2, 1984

[51] Int. Cl.[4] ..... F04D 29/10

[52] U.S. Cl. ..... 415/170 A; 415/196; 415/213 R; 415/174; 416/180; 416/186 R

[58] Field of Search ..... 415/133, 170 R, 172 R, 415/174, 140, 196, 197, 203, 204, 206, 170 A, 213 B, 213 R, 215; 416/180, 186 R, 241 R

[56] References Cited

U.S. PATENT DOCUMENTS

| | | | |
|---|---|---|---|
| 469,589 | 2/1892 | Pack | 415/140 |
| 1,585,669 | 5/1926 | Hansen | 415/173 R |
| 2,163,464 | 6/1939 | Llewellyn | 415/173 R |
| 2,166,436 | 7/1939 | Harlow | 415/198 |
| 2,366,251 | 1/1945 | Fullemann | 416/186 R |
| 2,371,588 | 3/1945 | Salerni | 416/186 R |
| 2,430,552 | 11/1947 | Bernal | 415/206 |
| 2,835,960 | 5/1958 | Rork | 416/241 R |
| 2,853,323 | 9/1958 | Engelking et al. | 277/96 |
| 2,910,313 | 10/1959 | La Bour | 384/477 |
| 3,018,736 | 1/1962 | Clay | 415/174 |
| 3,105,445 | 10/1963 | Gabbioneta | 415/214 |
| 3,146,722 | 9/1964 | Warman | 415/205 |
| 3,200,755 | 8/1965 | Mileti | 415/140 |
| 3,238,881 | 3/1966 | Camac | 415/196 |
| 3,511,185 | 5/1970 | Haentjens | 415/131 |
| 3,551,067 | 12/1970 | Wissman | 415/197 |
| 3,617,148 | 11/1971 | Endress | 415/206 |
| 4,095,806 | 6/1978 | Dempsey | 277/27 |
| 4,099,728 | 7/1978 | Wiese | 277/96 |
| 4,236,871 | 12/1980 | Hirst et al. | 416/186 R |
| 4,272,084 | 6/1981 | Martinson et al. | 277/30 |
| 4,335,997 | 6/1982 | Ewing et al. | 416/241 R |

FOREIGN PATENT DOCUMENTS

| | | | |
|---|---|---|---|
| 1082803 | 4/1957 | Fed. Rep. of Germany | 415/170 A |
| 2702308 | 8/1978 | Fed. Rep. of Germany | 415/170 A |
| 1096505 | 6/1955 | France | 415/204 |

*Primary Examiner*—Abraham Hershkovitz
*Assistant Examiner*—Joseph M. Pitko

[57] ABSTRACT

A cantilever shaft centrifugal pump including a volute casing and impeller within said casing and mounted on the end of the cantilever shaft. The volute chamber has an inlet coaxial with the axis of the cantilever shaft and an outlet extending tangentially of the wall of said volute casing. The impeller is of the shrouded type having spaced front and rear shrouds opening at the periphery of said shrouds with impeller vanes therebetween. The outer walls of the front and rear shrouds conform to arcs struck from the center of the bearings for the shaft, and the walls of the pumping chamber have clearance with the walls of the front and rear shrouds along arcs struck from the same center as the center of the walls of the front and rear shrouds. This accommodates radial excursions of the impeller and shaft upon large radial thrusts on the impeller and avoids catastrophic contact between the shrouds of the impeller and the stationary surfaces of the pumping chamber. The pumping chamber is sealed by mechanical seals having mating arcuate sealing faces extending about the cantilever drive shaft for the impeller, to accommodate free radial excursions of the shaft and impeller relative to the pump casing upon high thrust conditions without leakage along the cantilever drive shaft for the impeller.

13 Claims, 4 Drawing Figures

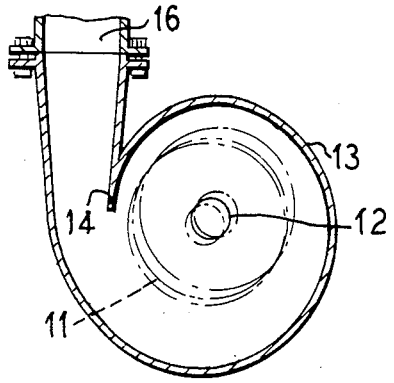
FIG. 1
FIG. 2
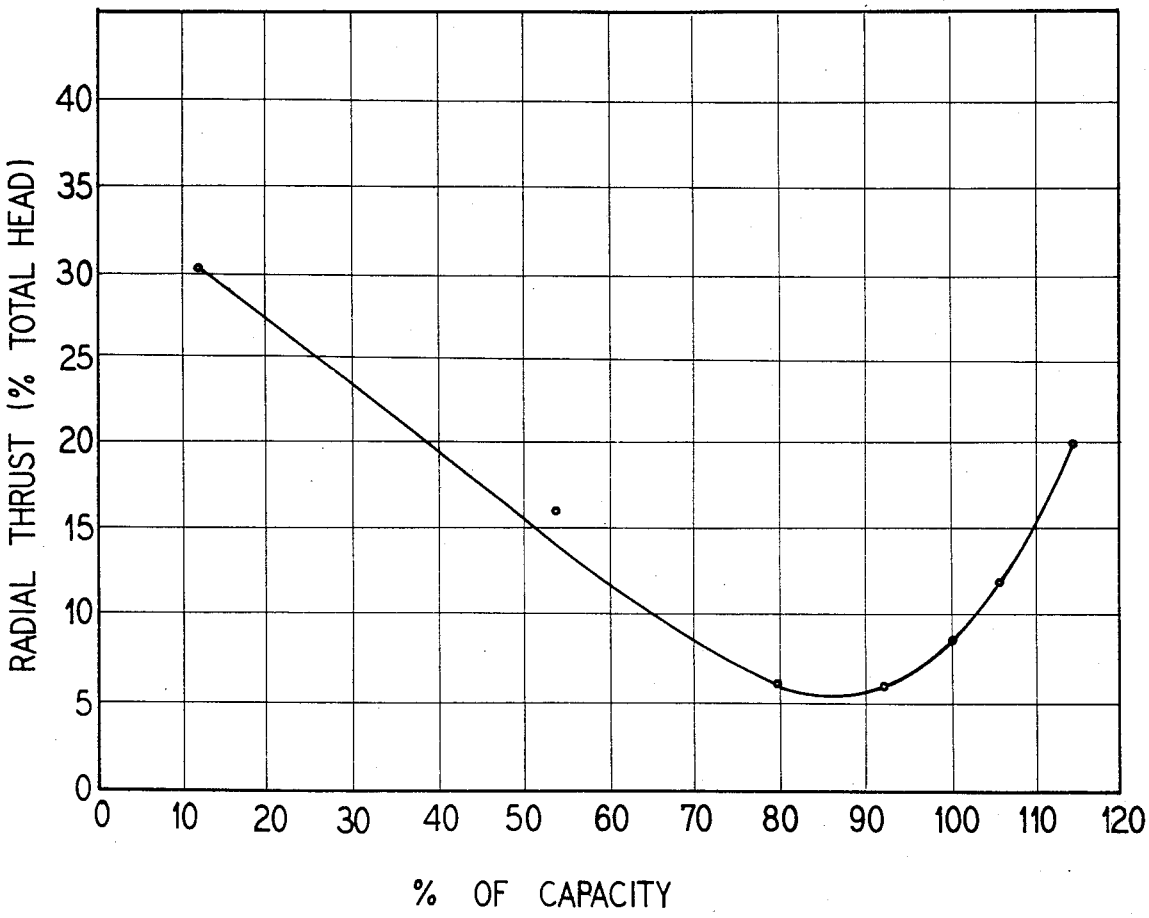

CENTRIFUGAL PUMP FOR WIDE RANGE OF OPERATING CONDITIONS

BACKGROUND AND SUMMARY OF INVENTION

Centrifugal pumps often operate over a wide range of hydraulic operating or capacity conditions. This results in problems caused by radial thrust in single volute pumps.

When the pump is operating close to shut-off or very close to shut-off conditions, a high radial thrust is produced. This can be minimized by the use of double or twin volute casings or by a circular casing, but many times construction limitations prohibit the use of such casings.

Assuming these construction limitations apply and it is not possible to use a double or twin volute casing or a circular casing, and a single volute casing should best be used, the radial thrust loads on the impeller must be taken into account. These loads will cause a deflection of the impeller drive shaft and the impeller thereon, which can be calculated.

Where the deflection of the drive shaft does not result in stresses which exceed the fatigue limit of the shaft, a single volute pump is feasible and may be so designed as to accommodate the deflection which occurs from the large radial thrust loads on the pump. This can be done by forming the front and rear shrouds of the impeller on arcs struck from a common center at the bearings for the shaft or between the bearings for the shaft where the shaft requires at least two bearings, and particularly where the bearings may be ball or roller bearings. The interior walls of the pump housing are also formed along arcs struck from the same center to provide close running clearance between the front and rear shrouds, and the pumping chamber, to avoid the danger of damage that may occur by catastrophic contact between the impeller and any of the stationary surfaces of the pump housing.

A mechanical seal spaced outwardly of the inboard bearings should take the place of the conventional stuffing box. The sealing faces of the mechanical seal should be formed from arcs struck from the same center as the center of the arcs along the back and front shrouds of the impeller. This accommodates free oscillatable movement of the shaft about the center of the radius of curvature of the front and rear shrouds of the impeller and the sealing faces of the pumping chamber.

A principal advantage of the present invention over prior centrifugal pumps is that by forming the impeller and interior walls of the pump housing to accommodate radial movement of the impeller and cantilever drive shaft therefor, under high thrust conditions on the impeller, damage to the impeller and pump housing, which would normally be caused by radial excursions of the cantilever shaft, is avoided.

A further advantage of the invention is the provision of a high capacity volute cantilever shaft pump in which the impeller may move relative to the volute pump housing about an axis centered at the bearings for the cantilever drive shaft without the liability of damaging the impeller or pump housing.

A further advantage of the invention is in the replacement of the conventional stuffing box for the cantilever drive shaft for the impeller by a mechanical seal in which the sealing faces of the seal are concentric with the front and rear shrouds of the impeller, and form effective seals during radial movement of the drive shaft for the impeller, caused by high thrust conditions on the impeller.

A principal object of the invention, therefore, is to improve upon the high capacity cantilever pumps heretofore in use by mounting the impeller drive shaft to move radially about an axis between the outboard bearings for the shaft and to provide clearance between the pump housing and front and rear shrouds of the impeller which conforms to radial movement of the shaft under high load conditions.

A still further object of the invention is to improve upon the high capacity volute types of cantilever shaft driven pumps heretofore in use, by contouring the impeller to enable it to move radially about an axis, the center of which is at the center of the inboard bearings for the impeller shaft, and to conform the pump housing to radial movement of the impeller, to compensate for the high radial thrust conditions occurring during starting and shut-off conditions of the pump.

A still further object of the invention is to provide a new and improved lined cantilever pump in which the lining is a wear and corrosion resistant material and is formed to allow radial movement of the impeller relative to its housing when the pump is operating under low capacity conditions, such as may be encountered when the impeller is operating very close to shut-off conditions or at actual shut-off conditions.

A still further object of the invention is to improve upon the high capacity volute pumps heretofore in use by lining the interior of the pump chamber with a corrosion resistant material which conforms to radial movement of the impeller, caused by radial excursions of its cantilever drive shaft, when operating under conditions close to shut-off conditions or at actual shut-off conditions.

Other objects, features and advantages of the invention will readily be apparent from the following description of a preferred embodiment thereof, taken in conjunction with the accompanying drawings, although variations and modifications may be effected without departing from the spirit and scope of the novel concepts of the disclosure.

DESCRIPTION OF THE DRAWINGS

FIG. 1 is a diagrammatic view taken through a high capacity volute pump constructed in accordance with the present invention, illustratively showing the extreme positions of the impeller and its cantilever drive shaft;

FIG. 2 is a graph plotting a preselected percentage of the radial thrust on the impeller of the pump of FIG. 1 in relation to a peselected percentage of the capacity of the pump;

DESCRIPTION OF PREFERRED EMBODIMENT OF INVENTION

Figure 3:
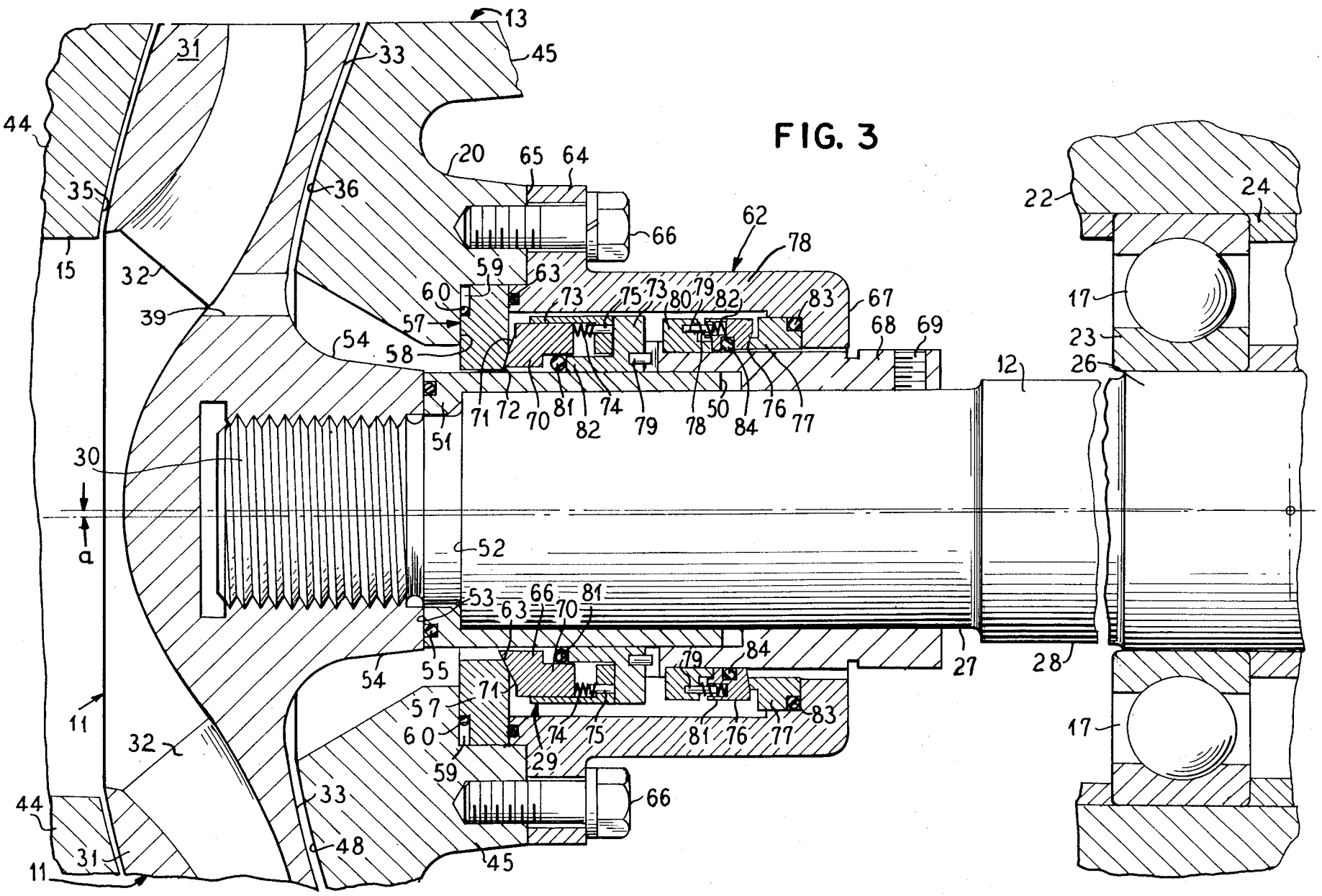
FIG. 3 is an enlarged fragmentary sectional view taken through a portion of the pump, and showing the drive shaft and the mechanical seal for said shaft, and also illustrating the clearance between the front and rear shrouds of the impeller and the interior of the pump housing in an exaggerated form.
Figure 4:
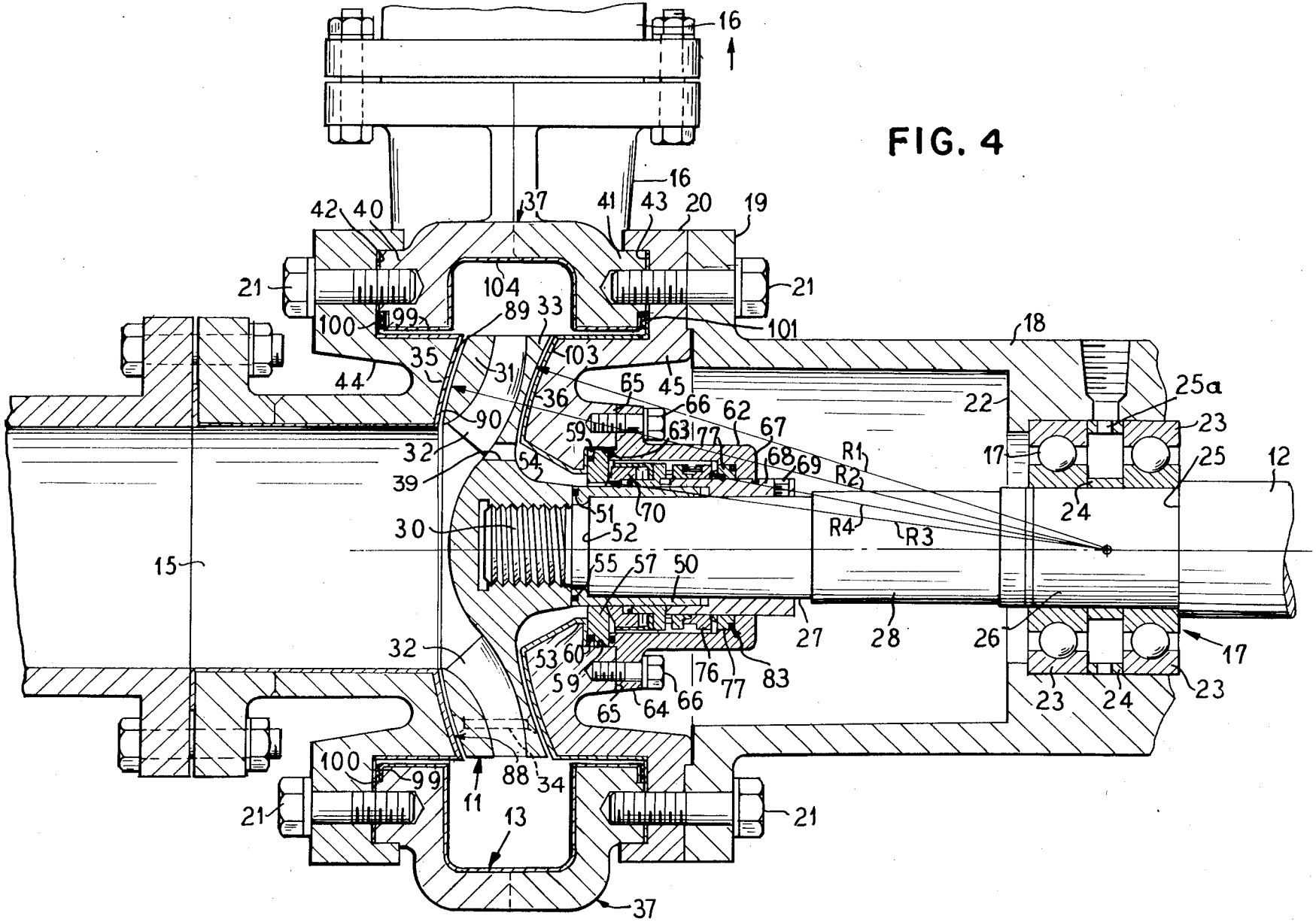
FIG. 4 is a view somewhat similar to FIG. 3 but drawn to a reduced scale and illustrating a lined high capacity cantilever shaft driven volute pump in longitudinal section, and diagrammatically showing the radii about which the pumping chamber, the front and rear faces of the impeller shrouds and pump housing are formed, and also showing the faces of the pumping chamber conforming to the front and rear impeller shrouds.

Referring now in particular to FIGS. 1, 3 and 4 of the drawings, FIG. 1 has been provided to illustratively show a type of pump which may carry out the principles of the present invention and diagrammatically illustrates the radial excursions the pump drive shaft and impeller may take upon normal operating and high thrust conditions.

The pump is shown in FIG. 1 as a volute type of pump having an impeller 11 of a conventional form carried on the end of a cantilever drive shaft 12 which may either be a horizontal or vertical shaft but is herein shown as a horizontal shaft. The impeller 11 on the drive shaft 12 extends within a volute casing 13 for the pump, coaxial with an inlet 15, (FIG. 3), and the axis of rotation of said impeller 11, and the cantilever drive shaft 12 for said impeller 11. An outlet 16 leads from the interior volute wall of the casing 13 tangentially thereof, and as illustratively shown in FIG. 1 is flanged although it need not necessarily be flanged and may be formed for connection with any conventional liquid transmission member. The juncture between said volute interior wall and said outlet 16 is conventionally termed a tongue and is designated by reference numeral 14.

It should be understood that FIG. 1 is strictly diagrammatic, to illustratively show the principles of the invention and that the impeller 11 has clearance with the volute interior of the casing 13, and conforms to the interior walls thereof, as will hereinafter more clearly appear as this specification proceeds.

The impeller 11 is shown in FIGS. 3 and 4 as being threaded on the cantilever end of the drive shaft 12, which is journaled to support said impeller 11 in cantilever relation with respect to opposed angular contact axial thrust bearings 17, herein shown as ball bearings, mounted in a bearing support member 18 having a flanged end 19 spaced outwardly of said bearings 17 and secured to a rear closure member 20 for the casing 13 as by machine screws 21.

The bearing support 18 has an inwardly extending annular or flanged portion 22 supporting outer races 23 of the angular contact axial thrust bearings 17. A spacer 24 spaces the races of said bearings apart. At least one oil hole **25*a* leads through said spacer 24 to the shaft 12 and between the races 23 for the angular contact axial thrust bearings 17. Said oil hole 25*a* may be connected to a supply of forced lubricant to supply lubricant equally to the opposed bearings 17 in a manner known to those skilled in the art, so not herein shown or described further. The bearings 17** while shown as ball bearings, need not be ball bearings but may be roller bearings of the thrust type or other conventional axial thrust bearings suitable for cantilever pump shafts.

As shown in FIGS. 3 and 4 the shaft 12 is stepped to reduce the diameter of the shaft in steps and has a shouldered portion 25 abutting a rear inner race of the outboard bearing 17. The shaft 12 further has reduced diameter portions 26 and 28 terminating into a reduced diameter portion 27 extending through and having a mechanical seal 29 mounted thereon, which will hereinafter be more clearly described as this specification proceeds. The extreme end of the shaft 12 extends within the casing 13 and is threaded as indicated by reference numeral 30 and has the impeller 11 threaded thereon. It is, of course, understood that the end of the shaft 12 may be straight or tapered and the impeller 11 may be keyed thereto and held in place by an impeller nut (not shown).

The impeller 11 may have front and rear shrouds 31 and 33 conforming to the inner faces of walls 35 and 36 of a housing portion for the impeller 11. Clearance is provided between the walls of the front and rear shrouds 31 and 33 and the faces of the walls 35 and 36 to accommodate radial excursions of the overhanging end of the shaft 12 caused by high radial thrusts on the impeller 11. The impeller 11 may also open to the periphery thereof and have conventional vanes 32 in the space between the shrouds 31 and 33.

The volute casing or chamber 13 and pump derives its name from the spirally shaped casing surrounding the impeller 11. This casing collects the liquid discharged by the impeller 11 and converts velocity energy into pressure energy.

A centrifugal volute pump increases in area from its initial point until it accompanies the full 360° around the impeller and then flares out generally tangentially of the casing to the discharge opening 16. The wall dividing the initial section and discharge portion of the casing is commonly called the tongue of the volute.

In a single volute pump casing design as diagrammatically shown in FIG. 1, uniform or near uniform pressures act on the impeller 11 when the pump is operating at design capacity which is the best efficiency of the pump. At other capacities the pressures around the impeller 11 are not uniform and there is a resultant radial reaction on the impeller. This radial reaction or force is greatest at shut-off of the pump and is a function of total head and of the width and diameter of the impeller 11. Thus a high head pump with a large impeller diameter will have a much greater radial reaction force at partial capacities than a low head pump with a small impeller diameter. A zero radial reaction is not often realized and the minimum radial reaction occurs close to design capacity.

The volute chamber 13 may be of various conventional forms and is shown in FIG. 4 as formed from a housing member 37 generally U-shaped in cross section, which may be split along the center of the volute and suitably connected together. Where the volute chamber 13 is unlined, it may be made from conventional materials, such as cast stainless steel, and the impeller 11 may be a one-piece casting machined to exact size after the casting operation. Where, however, the volute chamber 13 is lined with a corrosion resistant material, the casing 13 may be made of a material that has a higher melting point than the lining and usually cannot be cast.

The legs defining opposite sides of the U-shaped volute chamber 13 of the housing member 37 are shown in FIG. 4 as terminating adjacent the outer periphery of the impeller 11 on opposite sides thereof. Said legs have lugs 40 and 41 extending outwardly from opposite sides thereof within annular grooves 42 and 43 of respective front and rear closure members 44 and 45 for the pumping chamber 13. Said closure members 44 and 45 are shown as suitably secured to the respective lugs 40 and 41, as by the cap screws 21 (FIG. 4).

An inner face 35 of the front closure member 44 may be generally annular in form and is curved along an arc struck from a radius having its center along the axis of rotation of the shaft 12 and midway between the bearings 17 for said shaft 12.

An inner face 36 of the rear closure member 45 also has clearance with a rear shroud 33 of the impeller 11 and may be formed on an arc struck from the same center as the center from which the front and rear shrouds 31 and 33 of the impeller 11 are struck. The spacing between the front shroud 31 and inner face 35 of the front closure member 44 for the pumping chamber 13 and between the rear shroud 33 and the closure member or wall 36 for the pumping chamber 13 may be sufficient to accommodate radial excursions of the shaft 12 and impeller 11 about an axis spaced along the center line of said shaft 12 between the axial thrust bearings 17, which may occur due to variations in radial thrust on the impeller 11.

FIG. 4 shows by dash dot lines centered along the axis of the shaft 12 and midway between the bearings 17 the extreme angle of movement the shaft 12 and impeller 11 may take and designates this by reference character a. The spacing between the insides of the walls 35 and 36 of the pumping chamber 13 and the corresponding faces of the front and rear shrouds 31 and 33 of the impeller 11 thus must be sufficient to avoid all contact between the impeller 11 and inner faces 35 of the front closure member 44. It should here be understood that in conventional designs of such pumps there could be contact which may be catastrophic.

By constructing the inner faces 35 and 36 of the front and rear closure members 44 and 45 for the pumping chamber 13 along arcs struck from a radius, the center of which is on the center line of the shaft 12 and between the bearings 17, the clearance between the impeller 11 and inner faces 35 and 36 of the closure members 44 and 45 for the pumping chamber 13 may be substantially reduced over conventional constructions since any radial excursions of the shaft 12 and impeller 11 will conform to the inner faces 35 and 36 of the closure members 44 and 45 and the front and rear faces of the shrouds 31 and 33 of the impeller 11.

The mechanical seal 29, except for the arcuate sealing faces making the seal effective to inhibit leakage along the shaft 12 to the bearings 17, may be constructed along lines similar to the mechanical seal shown and described in my prior U.S. Pat. No. 3,511,187, dated May 12, 1970, so need only be referred to insofar as is necessary to disclose the features thereof providing good sealing qualities while accommodating radial excursions of the shaft 12 and impeller 11.

A sleeve 50 extends along the shaft 12 from the threaded portion thereof for a portion of the length of the stepped portion 27. Said sleeve 50 has a radially inwardly extending annular gib 51 conforming to a forward shouldered portion 52 of said shaft 12 and extending to a position adjacent the threads 30.

The mechanical seal 29 includes an annular sealing member 57 rectangular in cross section and having clearance with the sleeve 50. The sealing member 57 is carried in a right-angled annular recess 58 opening toward the sleeve 50 and having a slot 59 facing both open sides of the right-angled annular recess 58, and sealed thereto as by an O-ring 60. The opposite side of the seal 57 from the O-ring 60 is abutted by an inner end of a cage 62 for the mechanical seal 29 and is sealed to the inner end of said cage as by an O-ring 63.

The cage 62 has a flange 64 extending radially outwardly therefrom along a plane annular face 65 of the rear closure member 45 and secured thereto as by cap screws 66 or any other suitable securing devices.

The cage 62 at its inner end has a radially inwardly extending leg 67 terminating adjacent a rotatable sleeve 68 secured to the stepped portion 27 of the pump drive shaft 12 for rotation therewith, as by a set screw 69. An annular mechanical sealing member 70 is rotatable with the sleeve 68 and shaft 12, and has an arcuate sealing face 71 slidably engaging a corresponding sealing face 72 of the non-rotatable annular seal 57. The sealing faces 71 and 72 are struck from an arc centered between the bearings 17 for the shaft 12 and along the axis thereof.

The annular sealing member 70 is carried by a carrier 73 within the cage 62 and is biased to engage the sealing faces 71 and 72 with each other by a plurality of circumferentially spaced compression springs 74 on pins 75 mounted on the carrier 73 and extending therefrom toward the seal 57.

An O-ring 81 encircles the sleeve 50 and is recessed in a right-angled recess of the sealing ring 70 and engages an arm 82 of the carrier 73 to cooperate with the sealing faces 71 and 72 and reduce leakage along the sleeve 50.

A second set of mechanical sealing rings 76 and 77 is spaced outwardly from the sealing rings 57 and 70. Said sealing rings 76 and 77 are biased to slidably engage each other during rotation of the pump shaft 12, by compression springs 78 carried on pins 79 spaced about an annular carrier member 80 mounted on the sleeve 68 and extending outwardly therefrom and rotatable therewith.

The sealing rings 76 and 77 have engaging arcuate sealing faces, the arcs of which are struck from the same center as the center of the arcuate faces 71 and 72 of the sealing rings 57 and 70.

An O-ring 83 extends about a shouldered portion of the mechanical seal 77 and has sealing engagement with the inside of the cage 62 at the juncture of the leg 67 thereto.

A second O-ring 84 is carried in a downwardly opening recess in the sealing ring 76 and engages the outside of the sleeve 68 to cooperate with the sealing rings 76 and 77 and form an effective seal against leakage outside of the carrier 68 during radial excursions of the shaft 12.

The sealing members 57, 70, 76 and 77 may be made from a suitable material commonly used for mechanical seals and having good bearing and sealing properties. One form of commercial mechanical seal is sold under the name "Durametallic". Other forms of sealing materials may, of course, be used, determined by the texture or corrosive qualities of the material being pumped.

In FIG. 4 of the drawings, the clearance between the front and rear shrouds 31 and 33 of the impeller 11 and the pump casing 13 has been increased from that shown in FIG. 3 to accommodate the lining of the inner and outer front and rear closure members 44 and 45 and the volute 37 of the pump by a corrosive resistant material.

The liner is generally designated by reference numeral 88 and may be tantalum selected for its resistance to corrosion. Other materials such as manganese, austenitic steel, carbides or magnesium alloys which will withstand the corrosive action of the material pumped may also be used.

Where a corrosion resistant alloy like tantalum is used as a liner, it may be applied by a special fusion welding method, and where necessary, finished after its initial application, as by grinding or other machining operations suitable for finishing tantalum.

The impeller 11 should be of the same material as the liner 88. Assuming the impeller 11 and liner 88 are made from tantalum, the vanes 32, rear shroud 33 and hub of the impeller 11 may be milled from a forged blank. The front shroud 31, which may also be made from a forged blank, may be riveted or otherwise secured to the rear shroud 33 as by rivets 34, as shown in FIG. 4. The contour of the front shroud 31 should be equal to the contour of the vanes 32 to assure there be no leakage between the vanes 32 and front shroud 31. At least one equalizing passageway 39 may lead through the rear shroud 33, to prevent the buildup of pressure behind the impeller 11.

As shown in FIG. 4, the liner 88 includes a liner 89 which may extend along a seal 100 recessed in the end of the lug 40 to the end of the groove 42 formed in the front closure 44. It may also extend along the arcuate wall 35 and along the interior of said front closure 44 to the inlet 15 and may extend along said inlet 15 to the juncture of said inlet 15 to an inlet 15 pipe or the like. It should be understood that the liner 89 is cylindrical as it extends along the inlet 15 and then flares outwardly to conform to the arcuate wall 35 of the pumping chamber.

The liner 89 may be clamped and gasketed to the front closure member 44 of the volute pumping chamber 37 by the cap or machine screws 21.

A second liner 103 made of the same material as the liner 89 may extend along the face 36 of the rear closure member 45 and along an inner side of said rear closure member 45 downwardly away from the impeller 11 to the mechanical sealing member 57 along the slot 59 and sealed thereto as by the O-ring 60. The liner 103, like the liner 89, may also extend under a gasket 101 and may be fusion welded or otherwise secured to the respective faces 36 of the rear closure member 45 and provide uniform clearance between the outer face of said liner 103 and the rear faces of the shroud 33 of the impeller 11.

A liner 104 may line the volute 13 and bottom of the lugs 40 and 41 and be sealed to the outer sides of lug 40 by the respective annular gaskets 100 and 101. It may then extend along the volute 13 defined by the inner margins of the U-shaped channel 37 across the volute 13 and along the underside of said lug 41 and upwardly along the gasket 101 and clamped thereto by the cap screws 21. It should be understood that the liner 104 may be laid on the volute 13 by a special fusion welding process after the two halves of the volute 13 are bolted or welded together.

The liners 89, 103 and 104 need not necessarily be tantalum but may be made from other materials which will give a corrosion resistant lining to the interior walls of the front and rear closure members 44 and 45 extending along the front and rear shrouds 31 and 33 of the impeller 11.

The volute 13 of the pumping chamber 37 may be manufactured in two pieces and lined by the liner 104 as by fusion welding. It is understood, however, that the halves of the volute chamber 13 may be permanently bolted or otherwise secured together. The liners 89 and 103 may each be formed in one piece and welded or otherwise secured in place along the respective front and rear closure members 44 and 45 prior to assembly of the pump. The liner 103 as it extends along the rear side of the impeller 11 is formed to conform to an arc, the radius of which is centered between the angular contact axial thrust bearings 17, and assembled in place and clamped or welded to its casing parts to form the rear side of a pumping chamber cooperating with the impeller 11. The liner 103 as previously mentioned may be clamped in place by the annular gasket 100, lug 41 and the machine screw 21 or be fusion welded to the various parts lined by said liner.

It should be understood from the foregoing description and drawings that while I have shown and described a lined and unlined pump casing that other variations and modifications of the invention may be attained without departing from the spirit and scope of the novel concepts of the invention.

I claim as my invention:

1. A cantilever shaft volute pump operable over a wide range of operating conditions, comprising:

a casing forming a pumping chamber, an inlet into said casing, an impeller disposed within said casing and coaxial of the center of said inlet, said casing having a volute interior wall diverging from said inlet, an outlet from said casing forming a continuation of said volute interior wall and including a tongue extending generally tangentially thereof, a cantilever drive shaft having a first end extending within said casing coaxial with the axis of said impeller, said impeller being mounted on said first end of said drive shaft, axial thrust bearings spaced axially along said shaft outwardly of said casing and forming a cantilever support for said shaft and said impeller, said impeller having spaced apart front and rear shrouds and impeller vanes mounted extending between said front and rear shrouds, said front and rear shrouds of said impeller having outer and inner concentric curvilinear faces formed on radii centered at a center of reaction between said drive shaft and said bearings, front and rear interior walls of said casing having concentric curvilinear surfaces formed on radii centered at the center of reaction, said impeller being mounted for substantially uniform curvilinear clearance between said front and rear shrouds of said impeller and said respective front and rear interior walls of said casing to accommodate radial excursions of said shaft and said impeller upon variations in pressure on said impeller and said shaft from uniform pressure conditions and to prevent contact between said impeller and said front and rear interior walls of said casing.

2. A cantilever shaft volute pump of claim 1, further comprising:

a mechanical seal provided between said impeller and said bearings, said mechanical seal having mechanical sealing faces in slidable engagement with each other and formed on a radius centered between said bearings to accommodate radial excursions of said impeller and inhibit leakage of fluid about said shaft and into said bearings.

3. A cantilever shaft volute pump of claim 2, in which said volute interior wall is in alignment with and spaced radially outwardly of said impeller and the walls of said pumping chamber have clearance with said front and rear shrouds and generally conform to the form thereof, wherein said front and rear shrouds have outer faces struck from an arc centered at the center of said bearings, and wherein said mechanical seal extends about said shaft adjacent said casing and said impeller and has said sealing faces spaced from said front and rear shrouds of said impeller and struck from arcs having the same center as the center of the radii forming said front and rear faces of said shrouds of said impeller.

4. A cantilever shaft volute pump of claim 1, further comprising:

a pair of annular mechanical seals provided to seal said shaft from said pumping chamber and each including a pair of cooperating annular sealing members, each of said sealing members having an arcuate sealing face in cooperating engagement with an arcuate sealing face of another sealing member to form one of said pair of mechanical seals, and said arcuate sealing face of each of said sealing members being formed on radii centered between said bearings for said shaft.

5. A cantilever shaft volute pump of claim 4, in which said pair of mechanical seals is provided between said bearings and said impeller, wherein said sealing faces are movable relative to each other upon radial excursions of said shaft, wherein said sealing members include inboard and outboard sealing members in which the sealing faces thereof conform to arcs struck from radii centrally located between the centers of said bearings, and further comprising:

O-rings mounted to cooperate with said sealing faces to prevent the leakage of fluid along said shaft.

6. A cantilever shaft volute pump of claim 1, further comprising:

a non-deformable corrosion resistant liner for each wall of said pumping chamber adjacent said impeller and extending along opposite sides of said impeller and along the wall of the volute interior wall of said pumping chamber, and wherein said impeller is a double shrouded impeller and said fron and rear shrouds of said impeller have uniform clearance with said liners to accommodate radial excursions of said shaft and said impeller about an axis spaced along said shaft and centered between said bearings.

7. A cantilever shaft volute pump of claim 6, in which said liner is made from tantalum and said impeller is a double shrouded impeller made from a forged tantalum blank having vanes milled from said blank, said front shroud of said impeller being riveted to said rear shroud of said impeller by rivets passing through said vanes and said shrouds, and the contours of said front shroud and said vanes are equal to prevent leakage between said vanes and said front shroud.

8. A cantilever shaft volute pump of claim 1, including a separate non-deformable liner extending along the wall portions of said pumping chamber facing said impeller and along the volute of said pumping chamber and having clearance with said impeller, wherein said impeller is of the same material as the liner and the faces of said liners facing said front and rear shrouds of said impeller are arcuate in form, the arcs of which are struck from radii, the centers of which are centered between said bearings.

9. A cantilever shaft volute pump of claim 8, in which the wall portions of said casing extending along and spaced from said front and rear shrouds and the volute of said pumping chamber are lined with a corrosion resistant metallic liner and have uniform clearance with said front and rear shrouds of said impeller to accommodate radial excursions of said shaft and said impeller relative to said liner and prevent leakage of fluid thereby.

10. A cantilever shaft volute pump as claimed in claim 1, in which said impeller is a double shrouded impeller made from a non-corrosive forged blank and includes vanes milled from the forged blank, said front shroud being secured to said vanes and said rear shroud, the contour of said front shroud being equal to the contour of said vanes to assure the absence of leakage between said vanes and said front shroud.

11. A centrifugal shaft volute pump of claim 10, in which said front and rear shrouds of said impeller have curvilinear faces formed on a radius centered at the center of reaction of said bearings for said shaft, and in which curvilinear clearance is provided between said front and rear interior walls of said casing and said curvilinear faces of said front and rear shrouds of said impeller, and wherein said bearings for said shaft include spaced opposed angular contact radial axial thrust bearings.

12. In a high head centrifugal pump particularly adapted for pumping corrosive liquids and the like, a volute casing, an impeller within said having front and rear shrouds with impeller vanes therebetween, said shrouds having arcuate front and rear faces struck fron a common center, a cantilever drive shaft for said impeller extending within said casing, an inlet into one end of said casing coaxial with the axis of rotation of said drive shaft, an outlet from the large diameter portion of the volute of said casing, angular contact axial thrust bearings for said drive shaft spaced from said casing, said casing having interior front and rear walls having preselected clearance with said front and rear shrouds of said impeller and having arcuate front and rear faces struck from the same center as said front and rear shrouds of said impeller and generally conforming to said front and rear faces of said shrouds, a mechanical sealing assembly between said casing and said bearings for said shaft and including axially spaced pairs of mating rotatable and nonrotatable sealing members spaced along said drive shaft from said casing toward said bearings, said sealing members having sealing faces being arcuate in form and slidably engaging each other along an arc, the center of said arc being centered along said shaft at the center of reaction of said bearings for said shaft.

13. A high head centrifugal pump of claim 12, in which said casing is internally lined with a non-corrosive material and said impeller is made from at least one forged blank of the same material as said lining material.

* * * * *